US011766146B2

(12) United States Patent
Lane

(10) Patent No.: US 11,766,146 B2
(45) Date of Patent: Sep. 26, 2023

(54) HANGING APPARATUS WITH A TENSION MECHANISM

(71) Applicant: Matthew Heath Lane, Land O Lakes, FL (US)

(72) Inventor: Matthew Heath Lane, Land O Lakes, FL (US)

( * ) Notice: Subject to any disclaimer, the term of this patent is extended or adjusted under 35 U.S.C. 154(b) by 0 days.

(21) Appl. No.: 17/305,615

(22) Filed: Jul. 12, 2021

(65) Prior Publication Data

US 2022/0007869 A1 Jan. 13, 2022

Related U.S. Application Data

(60) Provisional application No. 62/705,686, filed on Jul. 10, 2020.

(51) Int. Cl.

| | |
|---|---|
| ***A47G 25/44*** | (2006.01) |
| ***A47G 25/48*** | (2006.01) |
| ***A47G 25/20*** | (2006.01) |

(52) U.S. Cl.

CPC ..... *A47G 25/44* (2013.01); *A47G 25/20* (2013.01); *A47G 25/483* (2013.01)

(58) Field of Classification Search

CPC ..... A47G 25/20; A47G 25/44; A47G 25/483; A47G 25/48; A47G 25/62; D06F 59/02

See application file for complete search history.

(56) References Cited

U.S. PATENT DOCUMENTS

| | | | | | |
|---|---|---|---|---|---|
| 371,038 | A | * | 10/1887 | Davis | D06C 3/00 38/102.4 |
| 557,603 | A | * | 4/1896 | Raphael | D06F 59/02 223/69 |
| 604,122 | A | * | 5/1898 | O'Thayne | D06F 59/02 223/69 |
| 1,049,871 | A | | 1/1913 | Ketelsen | |
| 1,077,460 | A | | 11/1913 | Duncan | |
| 1,243,741 | A | | 10/1917 | Jakab | |
| 1,253,608 | A | * | 1/1918 | Lambert | D06F 59/02 223/69 |
| 1,390,054 | A | * | 9/1921 | McNeely | A47G 25/62 38/102.4 |
| 1,579,385 | A | | 4/1926 | Nelson | |
| 1,769,882 | A | * | 7/1930 | Blaine | D06F 59/02 34/106 |
| 1,787,165 | A | * | 12/1930 | Peebles | D06F 59/02 223/69 |
| 1,856,064 | A | * | 5/1932 | Alexander | A47G 25/62 38/102.4 |
| 1,978,123 | A | * | 10/1934 | Anderson | A47G 25/20 223/69 |
| 1,989,458 | A | * | 1/1935 | Martin | A47G 25/20 223/69 |
| 1,990,454 | A | * | 2/1935 | Johnston | A47G 25/20 223/69 |
| 2,055,744 | A | * | 9/1936 | Grunkemeyer | A47G 25/62 223/91 |

(Continued)

FOREIGN PATENT DOCUMENTS

GB 191223241 A * 11/1912

*Primary Examiner* — F Griffin Hall

(74) *Attorney, Agent, or Firm* — Dunlap Bennett & Ludwig, PLLC

(57) ABSTRACT

A hanging apparatus with a tension mechanism for selectively stretching and straightening hung articles.

10 Claims, 3 Drawing Sheets

(56) References Cited

U.S. PATENT DOCUMENTS 2,079,726 A * 5/1937 Wilson ..... A47G 25/20 34/106
2,091,817 A * 8/1937 Jacobus ..... D06F 59/02 223/69
2,119,604 A * 6/1938 Shepherd ..... A47G 25/20 223/69
2,335,243 A * 11/1943 Grieshaber ..... A47G 25/62 223/85
2,484,806 A * 10/1949 Larson ..... A47G 25/20 223/69
2,761,599 A * 9/1956 Lancaster ..... A47G 25/14 223/92
2,827,211 A 3/1958 Bradley
2,850,219 A * 9/1958 Glotzer ..... A47G 25/62 D6/326
2,940,646 A 6/1960 Richa
3,790,043 A * 2/1974 Hagen ..... A47G 25/62 223/96
5,613,628 A 3/1997 Burkhalter
5,915,605 A * 6/1999 Blanchard ..... A47G 25/485 223/91
D561,958 S * 2/2008 Hahn ..... D32/17
7,337,931 B2 * 3/2008 Edwards ..... A47G 25/62 223/61
8,028,868 B2 10/2011 Mangano
8,201,310 B1 * 6/2012 Abdi ..... D06F 55/02 24/507
8,678,250 B2 3/2014 Williams
9,068,289 B2 6/2015 Moon et al.
9,290,875 B2 3/2016 Fogg
9,474,400 B2 * 10/2016 Farris ..... A47G 25/4023
9,492,026 B2 * 11/2016 Naeger ..... A47G 25/0685
9,901,205 B2 2/2018 Fogg
2008/0217364 A1 * 9/2008 Fong ..... D06F 59/02 223/89
2017/0342650 A1 * 11/2017 Mainini ..... D06F 59/02
2020/0154921 A1 5/2020 Jewayniain
2022/0117424 A1 * 4/2022 Yoon ..... A47G 25/20
2022/0183490 A1 * 6/2022 Yoon ..... A47G 25/62

* cited by examiner

HANGING APPARATUS WITH A TENSION MECHANISM

CROSS-REFERENCE TO RELATED APPLICATION

This application claims the benefit of priority of U.S. provisional application No. 62/705,686, filed 10 Jul. 2020, the contents of which are herein incorporated by reference.

BACKGROUND OF THE INVENTION

The present invention relates to hanging devices, and more particularly, to a hanging apparatus with a tension mechanism which selectively stretches and straightens clothing.

During the lifecycle of an article of clothing and/or garment, most material will naturally stretch, shrink, wrinkle, or otherwise deform to a condition that is less aesthetically pleasing than its intended shape. In the textile arts, blocking is a method of adjusting or maintaining the shape of a finished piece so that the article of clothing does not deviate from its intended shape and size.

Previous methods for blocking articles of clothing, however, relied on a manual process involving one or more individuals. Simply put, current methods for blocking articles of clothing produce unreliable results and may unintentionally result in either damage to the garment or failure to reform the garment in a manner consistent with its intended shape or size.

As can be seen, there is a need for a hanging apparatus with a tension mechanism which selectively stretches and straightens clothing, thereby providing a solution to one or more of the foregoing problems.

SUMMARY OF THE INVENTION

In one aspect of the present invention, a hanging apparatus for selectively stretching and straightening hung articles, the hanging apparatus may include the following: a frame; one or more first clips along an upper portion of the frame; and one or more second clips downward of the one or more first clip, wherein the one or more second clips is selectively moveable relative to the one or more first clips.

In another aspect of the present invention, the hanging apparatus may further include a hanger disposed upward of the one or more first clips; a lateral member providing the one or more second clips; a tension member operatively associated with the lateral member for selectively moving the lateral member relative to the one or more first clips by way of an adjusting mechanism, wherein the adjusting mechanism converts a rotational motion to a linear motion defined by movement of the one or more first clips relative to the one or more second clips, wherein the adjusting mechanism is a linear actuator; an exterior portion of the tension member, wherein the adjusting mechanism meshes with the exterior portion, wherein the exterior portion are threads or notches; a drive mechanism operatively associated with the tension member to impart the rotational motion thereto; a locking mechanism configured to move the tension member between a locked condition and an unlocked condition preventing relative linear motion between the one or more first clips and the one or more second clips; and a slot operatively associated with each of the one or more first clips in such a way that each first clip is laterally slidable between zero and six inches.

These and other features, aspects and advantages of the present invention will become better understood with reference to the following drawings, description and claims.

DETAILED DESCRIPTION OF THE INVENTION

Figure 1:
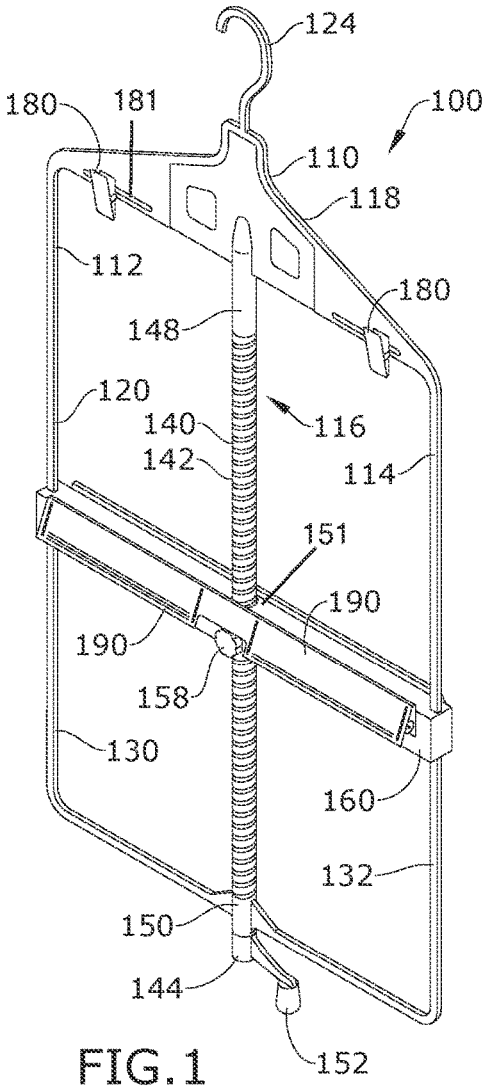
FIG. 1 is a perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

It should be understood by those skilled in the art that the use of directional terms such as upper (top), lower (bottom), lateral (side), and the like are used in relation to the illustrative embodiments as they are depicted in the figures. Specifically, the upper direction being toward the top margin of the drawing sheet of FIG. 2, the lower direction being toward the bottom of the drawing sheet of FIG. 2, and the lateral direction being directed to the left and/or right margins of the drawing sheet of FIG. 2.

Broadly, an embodiment of the present invention provides a hanging device with a tension mechanism which selectively stretches and straightens clothing.

In one aspect, the hanging device of the present invention may, to a large degree, remove the human element from the process of hanging and blocking clothing and may provide a standardized system that will produce a more reliable and desired result in the blocking, reshaping, stretching, and straightening of clothing.

In a further aspect, the hanging device of the present invention may stretch the fabric back to its original size and shape.

The hanging device of the present invention differs from and distinguishes over currently existing hanging devices. There are no similar inventions to date. Previous devices and methods have relied upon a manual process involving one or more individuals, which have varied based on the individual attempting to reform the garment and the method of reformation. The hanging device of the present invention may remove the human element from the process and provide a standardized system that will produce a more reliable and desired result.

In an exemplary embodiment, the hanging device of the present invention may also be used to produce a new product as a result of stretching and reforming an original product.

Referring now to FIGS. 1 through 7, wherein like reference numerals designate corresponding parts, in an exemplary embodiment of the present invention, a hanging apparatus is provided.

The invention will best be understood with reference to the drawings when taken in connection with the accompanying descriptive portion of the specification following hereinafter. In the drawings the components in the figures are not necessarily to scale, emphasis being placed upon illustrating the principles of the design. The components may be of any suitable dimension, including the dimensions shown. Moreover, in the figures, like reference numerals designate corresponding parts throughout the different views. The specific examples of the invention as herein shown and described are for illustrative purposes.

Figure 2:
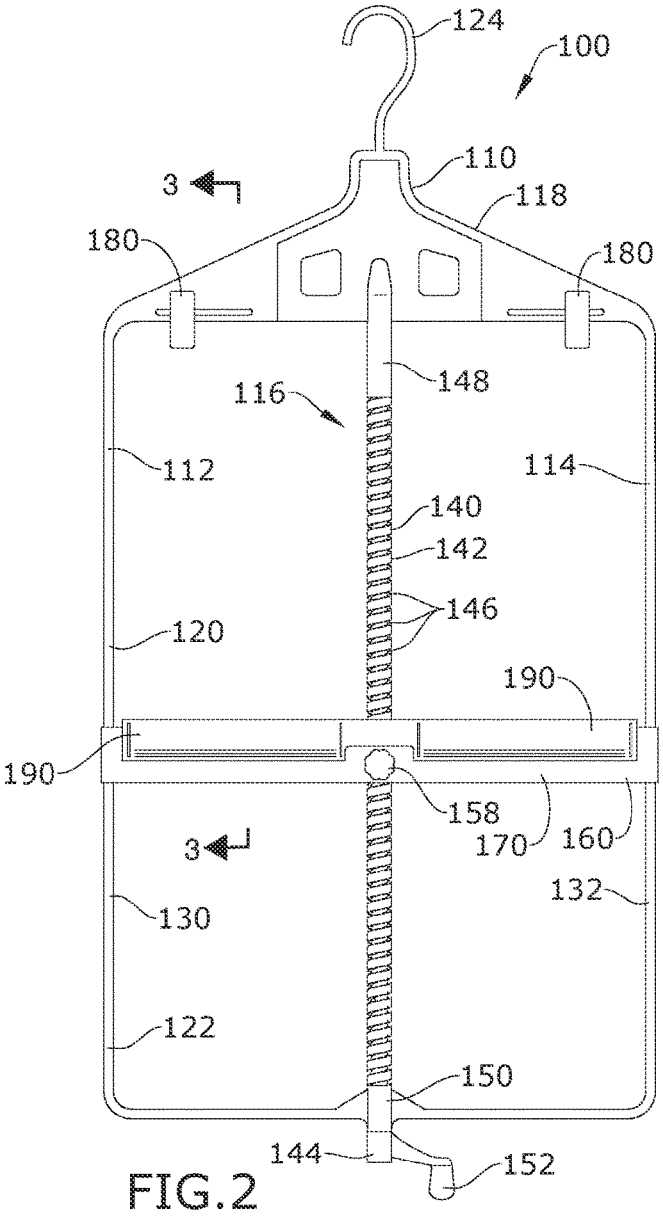
FIG. 2 is a front elevation view of an exemplary embodiment of the present invention.

Referring now to FIG. 1 and FIG. 2, in an exemplary embodiment, the present invention may comprise a hanging apparatus 100,200 with a tension mechanism that automatically stretches and straightens clothes. The hanging apparatus 100,200 may further comprise the following elements:

1. A hanging apparatus frame 110,210 having a first outer side portion 112,212, a second outer side portion 114,214 a central portion 116,216, a top portion 118,218 a middle portion 120,220 and a bottom portion 122,222, the hanging apparatus frame 110,210, and further comprising a hanger element 124,224;

2. A first vertical side bar 130,230 located at or, in certain embodiments, may be a continuation of the first outer side portion 112,212 of the hanging apparatus frame 110,210, and a second vertical side bar 132,232 located at or, in certain embodiments, may be a continuation of the second outer side portion 114,214 of the hanging apparatus frame 110,210;

3. A central vertical tension member 140,240 located at the central portion 116,216 of the hanging apparatus frame 110,210 the central vertical bar further comprising an exterior portion 142,242 and a central vertical tension bar adjustment means 144,244;

4. A middle horizontal member 160,260 with a grasping mechanism 170,270;

5. A pair of removable interchangeable upper grasping clips 180,280 located at the top portion 118,218 of the hanging apparatus frame 110,210; and 6. Interchangeable horizontal bar grasping clips 190,290 for the middle horizontal bar 160,260.

In an exemplary embodiment of the present invention, the hanging apparatus 100,200 and the components thereof may be made of any suitable material and by any suitable process. For example, without limitation, the hanging apparatus may be made of any plastic material, by 3-D printing or injection molding. Portions of the hanging apparatus frame 110,210 may be attached together by any suitable means or may be integrally formed. The portions of the hanging apparatus frame 110,210 being illustrated may be substantially cylindrical, however, it is apparent that any other suitable cross-section, for example without limitation, square, rectangular, or the like, could be provided. Various other changes in structure will no doubt occur to those skilled in the art and will be understood as forming a part of the present invention insofar as they fall within the spirit and scope of the appended claim.

In an exemplary embodiment, the hanger element 124,224 may comprise any suitable hanger hook, such as a conventional c-shaped hanger hook.

In some embodiments of the present invention, the vertical side bars 130,132,230,232 are attached to or integrally formed with the hanging apparatus frame 110,210. In some embodiments, the vertical side bars 130,132,230,232 may be adjustable. In some embodiments of the present invention, the vertical side bars 130,132,230,232 may be of varying shape or design.

In an exemplary embodiment of the present invention, the central vertical tension bar 140,240 is attached to or integrally formed with the hanging apparatus frame 110,210 and may be provided with any suitable cross-sectional shape. For example, without limitation, in some embodiments, the central vertical bar may be provided with a cylindrical, flattened, squared, or rectangular-like shape. In some embodiments of the present invention, the central vertical bar may comprise a threaded central vertical bar. In other embodiments of the present invention, the central vertical bar may comprise a notched central vertical bar. The threads or notches may be constructed and arranged to provide vertical height adjustability of the middle horizontal bar, which may be raised and lowered along the two adjustable vertical side bars.

The middle horizontal bar 160 may be constructed and arranged to slide up and down the central vertical bar 140,240 and the vertical side bars 112,212,114,214,130,132,230,232. The interchangeable horizontal bar grasping clips 190,290 are attached to the middle horizontal bar 160,260 of the hanging apparatus 100,200. The middle horizontal bar 160,260 may be selectively raised, lowered and set along the two adjustable vertical side bars 130,132,230,232 and central vertical tension member 140,240 by operative association of the middle horizontal bar 160,260 and at least the central vertical tension member 140,240. In certain embodiments, the exterior portion 142, 242 (which may include exterior threading 146 or apertures 246) of the central vertical tension member 140,240, respectively, operatively associates with an adjusting mechanism 151, 251 that converts rotational motion to linear motion and/or a torque (rotational force) to a linear force. The adjusting mechanism 151, 251 may be a linear actuator (not shown) such as a worm gear rotatable by way of a knob 258, respectively, or in other embodiments by a drive mechanism 144, wherein the worm gear or equivalent engages the exterior portion 142, 242. In certain embodiments, the knob 158,258 may be a locking mechanism that enables a user to selectively set or lock the adjusting mechanism 151, 251 (or in otherwise lock the movement of the middle horizontal bar 160,260 relative to the vertical tension member 140,240).

With particular reference to FIG. 1, in some embodiments of the present invention, the central vertical tension bar 140 may have a cylindrical shape and may further comprise exterior threads 146 located on the exterior surface portion 142 thereof. Central vertical tension bar 140 may be rotatably mounted in an upper central holder 148 and a lower central holder 150. And the adjusting mechanism 151 may work in concert with the drive mechanism 144 in that the drive mechanism 144, in certain embodiments through manual rotation, is operatively associated with the central vertical tension bar 140 to make it selectively rotate and thereby engage the adjusting mechanism/means 151. It may be advantageous to have a rotatable handle substantially below the horizontal bar grasping clips 190 as articles of clothing may have dependent element hanging that would otherwise interfere with the rotation process. Accordingly, the vertical height of the entire frame, from upper grasping clips 180 to the rotatable handle 152 may be between two feet to more than six feet.

Again, the drive mechanism 144 may further comprise a rotatable handle 152 associated with the central vertical tension bar 140, constructed and arranged to rotate central vertical tension bar 140, the central vertical tension bar 140 being operably connected to the middle horizontal bar 160, so that the middle horizontal bar 160 is raised and lowered on the central vertical tension bar 140 in response to rotation of the rotatable handle 152 to adjust the tension. The side bars 130,132 provide stability and a uniform tension and "stretch" the garment, while the central vertical tension bar 140 bar holds the desired tension to the garment. The user adjusts the middle horizontal bar in a downward motion to achieve the desired result and adjusts or changes relative the upper grasping clips 180 and middle horizontal bar grasping clips 190 based on the type of garment. The upper grasping clips 180,280 may be each, respectively, operatively associated with a slot 181, 281 so that the clips 180, 280 may be slid or otherwise selectively moved laterally.

Figure 3:
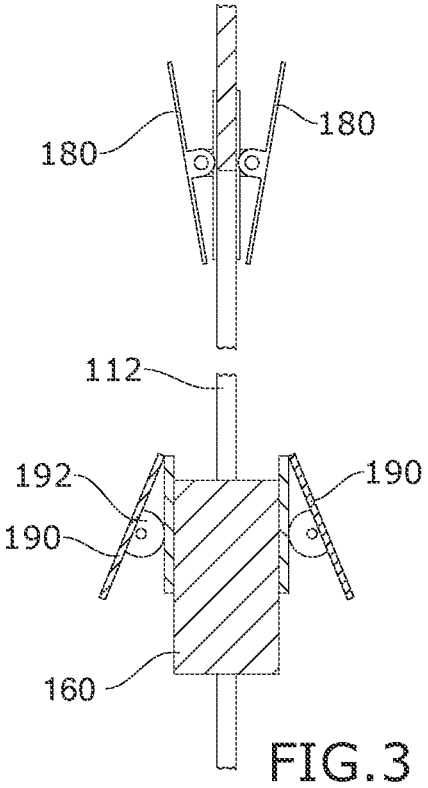
FIG. 3 is a section view of an exemplary embodiment of the present invention, taken along line 3-3 in FIG. 2, illustrating the 180 clips and the 190 clips in a closed condition.
Figure 4:
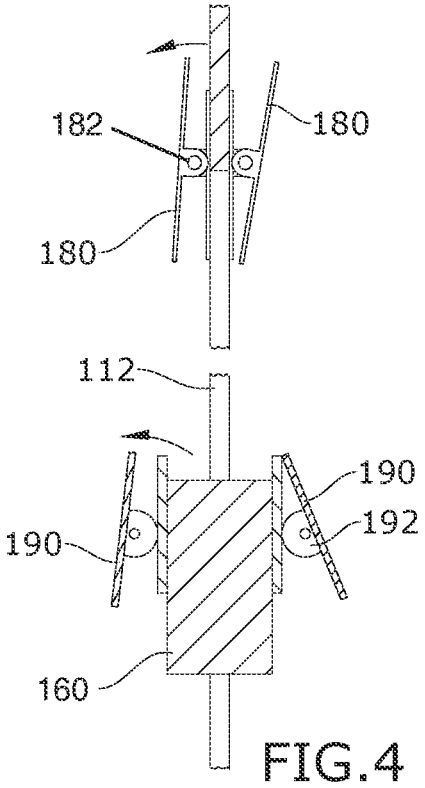
FIG. 4 is a duplication of FIG. 3, illustrating one of each of the 180 and 190 clips in an open condition, respectively.

As seen at FIGS. 3 and 4, a partial side cross-sectional view along line 3-3 of FIG. 2, the mechanisms and functions of grasping clips 180 and 190 is shown in further detail, including pivot connections 182 and 192, respectively.

Figure 6:
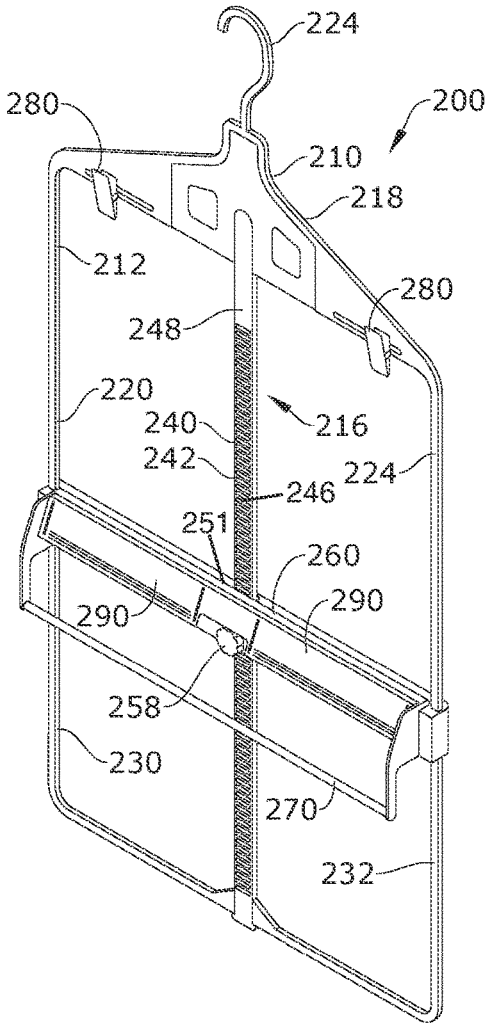
FIG. 6 is a perspective view of an exemplary embodiment of the present invention.
Figure 7:
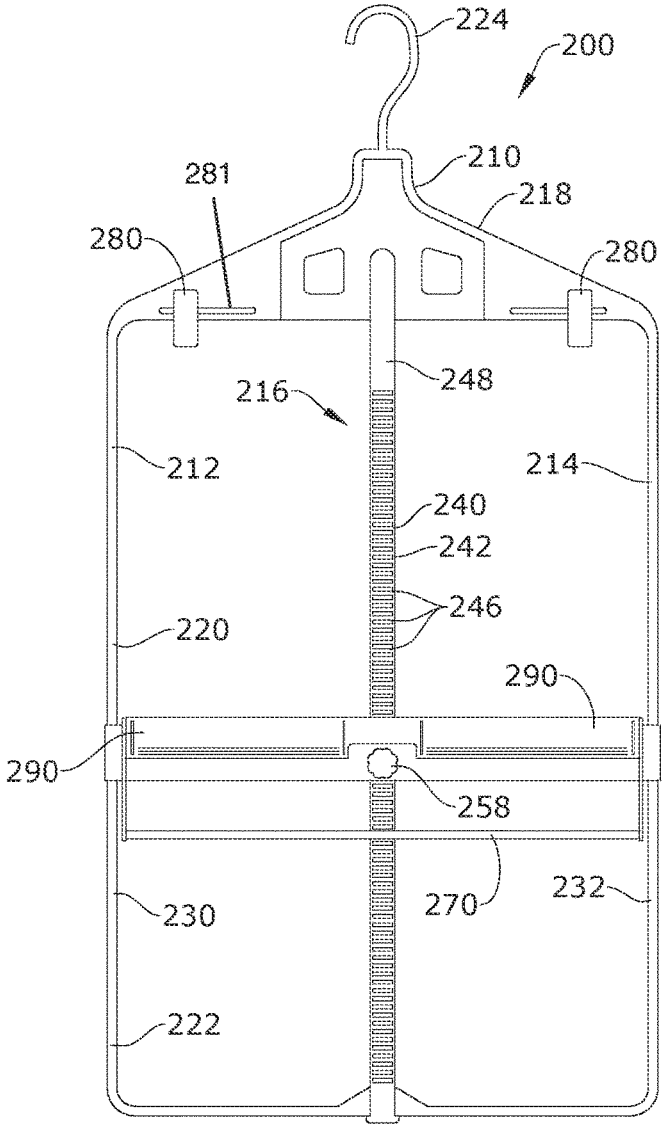
FIG. 7 is a front elevation view of an exemplary embodiment of the present invention.

With particular reference to FIGS. 6 and 7, in other embodiments, the central vertical tension bar 240 may have a flattened, squared or rectangular-like cross-sectional shape, may further comprise a plurality of horizontal notches 246 provided along the exterior surface portion 242. In one embodiment, the side bars 230,232 provide stability and a uniform "stretch" of the garment, while the central vertical bar with notches holds the desired tension to the garment. The user adjusts the middle horizontal bar in a downward motion to achieve the desired result and adjusts or changes the grasping clips of both the hanging apparatus and middle horizontal bar based on the type of garment. The middle horizontal bar 260 is raised and lowered on the central vertical tension bar 240 manually by the user to adjust the tension by way of the tension adjustment mechanism 251 that may be completely actuated by rotational knob 258. The side bars 230,232 provide stability and a uniform tension and "stretch" the garment, while the central vertical tension bar 240 bar holds the desired tension to the garment. The user adjusts the middle horizontal bar in a downward motion to achieve the desired result and adjusts or changes both the upper grasping clips 280 and middle horizontal bar grasping clips 290 based on the type of garment. The grasping mechanism 270 may be a member spaced apart from the frame 210 and downward of the grasping clips 290.

In an exemplary embodiment, the present invention further provides a method. An apparatus or system is assembled and adjusted as heretofore described. The middle horizontal bar is adjusted along the tension bar until the desired length and form is achieved.

In some embodiments of the present invention, the side vertical bars and central vertical bar may be provided in any suitable cross-sectional dimension or provided to make into different shapes, as long as the middle horizontal bar is constructed and arranged to adjustably slide along the side vertical bars and central bar, to provide adjustable tension to a garment installed on the apparatus. In some embodiments of the present invention, the holes in the middle horizontal bar that allow it to slide over the side and central vertical bars may have any suitable shape, such as, for example without limitation, a standard "o" type hole. In some embodiments, the hanging apparatus may be provided with an alternative construction wherein the middle horizontal bar may be adjustable from left to right, right to left, up to down, or down to up, or possibly a diagonal movement as long as there is tension applied to the garment. In some embodiments of the present invention, either the side vertical bars, or central vertical bar, may be eliminated in a construction comprising at least one bar that holds the tension on the garment. In some embodiments of the present invention, a garment may be attached to the hanging apparatus frame and the middle horizontal bar using different types of clips of methods of attachment. In some embodiments of the present invention there may be alternative methods of applying the tension between the hanging apparatus frame and the middle horizontal bar with any suitable grasping mechanism.

Figure 5:
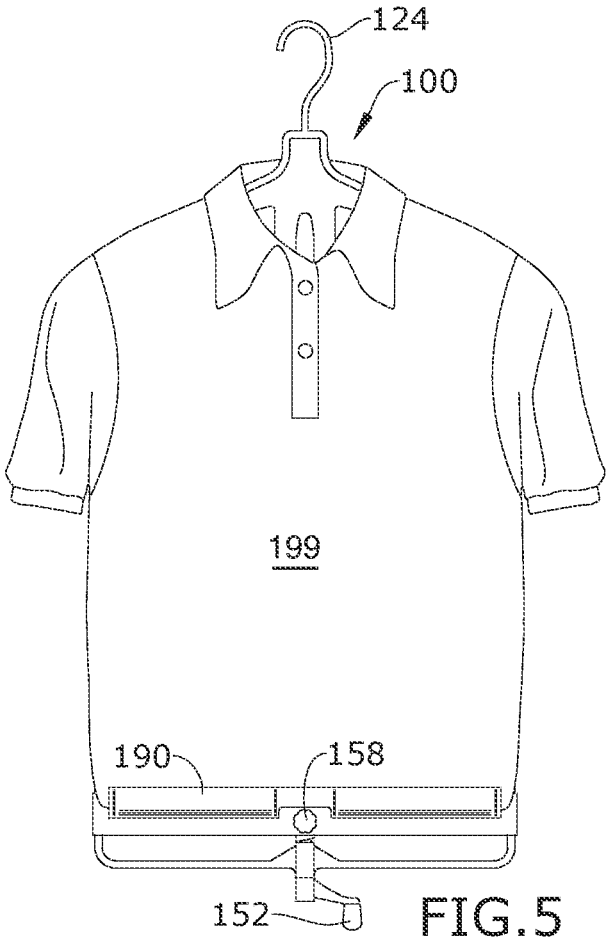
FIG. 5 is a front elevation view of an exemplary embodiment of the present invention, shown in use.

In one embodiment, the hanging apparatus of the present invention may provide a simple to use method: to use this invention, the user simply needs to attach a garment to the hanging apparatus frame and to the middle horizontal bar, attached the lower gripping clips 190/290 to a lower portion of the garment 199, as illustrated in FIG. 5, and then vertically slide the horizontal bar until the desired length or form is achieved.

In some embodiments, the apparatus and method of the present invention may be used to stretch any article that is sufficiently pliable.

In other embodiments, the apparatus and method of the present invention may produce a new product, as a result of stretching and reforming an original product.

In summary, in an exemplary embodiment, the present invention provides a hanging device with a tension mechanism that automatically stretches and straightens clothing. The device of the present invention may remove the human element from the process and provide a standardized system that will produce a more reliable and desired result.

In addition, embodiments of the present invention have application to a wide range of industries. To the extent the present application discloses a system, the method implemented by that system is within the scope of the present invention. Further, to the extent the present application discloses a method, a system of apparatuses configured to implement the method are within the scope of the present invention.

It should be understood, of course, that the foregoing relates to exemplary embodiments of the invention and that modifications may be made without departing from the spirit and scope of the invention as set forth in the following claims.

What is claimed is:

1. A hanging apparatus for selectively stretching and straightening hung articles, the hanging apparatus comprising:

a frame comprising:
an upper member;
a lower member; and
two side members;

a vertical member interconnecting central portions of the upper and lower members;

a horizontal element providing one or more clips, wherein a central portion of the horizontal element providing a linear actuator operatively associates with the vertical member in such a way that each end of the horizontal element slides along one of the two side members so that the one or more clips are selectively moveable relative to the upper and lower members by operating a drive mechanism disposed below the lower member, wherein the drive mechanism is rotatably connected to the vertical member for engaging the linear actuator;

a handle operatively connected to the drive mechanism;

an exterior portion of the vertical member, wherein the linear actuator meshes with the exterior portion, wherein the exterior portion comprises threads; and a locking mechanism configured to move the vertical member between a locked condition and an unlocked condition preventing relative linear motion of the horizontal element in the locked condition, whereby a garment sheathing the frame is stretched when a lower portion of the garment is engaged by the one or more clips.

2. The hanging apparatus of claim 1, further comprising a hanger disposed upward of the upper member.

3. The hanging apparatus of claim 2, wherein the drive mechanism is a grab bar.

4. The hanging apparatus of claim 1, wherein the one or more clips are bar clips.

5. The hanging apparatus of claim 1, wherein the one or more clips comprise two or more clips on opposing sides of the horizontal element.

6. The hanging apparatus of claim 5, further comprising one or more upper clips disposed along the upper member.

7. The hanging apparatus of claim 6, further comprising a slot operatively associated with each upper clip in such a way that each upper clip is laterally slidable between zero and six inches.

8. The hanging apparatus of claim 7, wherein the one or more upper clips comprise two or more upper clips on opposing sides of the upper member.

9. The hanging apparatus of claim 8, wherein the upper clips are facing the clips along the horizontal element.

10. The hanging apparatus of claim 1, wherein the locking mechanism is a rotatable knob.

* * * * *